US007096515B2

(12) United States Patent
Navon

(10) Patent No.: US 7,096,515 B2
(45) Date of Patent: Aug. 29, 2006

(54) CARTRIDGE DEVICE AND METHOD FOR ADDING SUPPLEMENTS TO A TOILET CISTERN

(76) Inventor: Avner Navon, Moshav Pedaya 81 (IL) 99796

( * ) Notice: Subject to any disclaimer, the term of this patent is extended or adjusted under 35 U.S.C. 154(b) by 117 days.

(21) Appl. No.: 10/775,121

(22) Filed: Feb. 11, 2004

(65) Prior Publication Data

US 2005/0172383 A1 Aug. 11, 2005

(51) Int. Cl.
*E03D 9/02* (2006.01)

(52) U.S. Cl. ..... 4/227.1

(58) Field of Classification Search ..... 4/227.1–227.4
See application file for complete search history.

(56) References Cited

U.S. PATENT DOCUMENTS 2,320,128 A * 5/1943 Hall ..... 4/227.3
5,903,930 A * 5/1999 Huang ..... 4/227.4

* cited by examiner

*Primary Examiner*—Charles E. Phillips
(74) *Attorney, Agent, or Firm*—Mark M. Friedman

(57) ABSTRACT

A device for introducing a chemical supplement to a toilet cistern without having to displace a cover of the toilet cistern, including: (a) a dispensing unit having a releasing mechanism, disposed within the cistern, for releasing the chemical supplement into the cistern, and (b) a housing, associated with the releasing mechanism and disposed within the cistern, for receiving a cartridge containing the chemical supplement, and (c) an attachment mechanism for securing the device to a surface of the toilet cistern.

20 Claims, 4 Drawing Sheets

CARTRIDGE DEVICE AND METHOD FOR ADDING SUPPLEMENTS TO A TOILET CISTERN

FIELD AND BACKGROUND OF THE INVENTION

The present invention relates to a cartridge device for introducing chemical supplements to a toilet cistern and, more particularly, to a cartridge device for introducing chemical supplements to a toilet cistern without having to displace the cover of the toilet cistern.

There are various ways of adding supplements such as detergent to water in a toilet cistern. One simple way is to put a solid block of cleaning material containing an adsorbed dye into a holder disposed within the cistern. The cleaning material is then slowly dissolved in the water within the cistern. A weakening color of the water indicates that the cleaning material is running out and that the block of cleaning material needs to be replaced. However, the block of cleaning material gives off cleaning material at a rate that depends primarily on the surface area of the block, such that the concentration of cleaning material in water is far from constant, and is highly dependent on the time elapsed since the toilet was last flushed.

A more sophisticated way of introducing detergent to water in a toilet cistern is to place a dispenser containing a cleaning liquid inside the cistern. When the water level in the cistern changes, cleaning liquid from the dispensing container is dispensed by any of various types of dispensing systems. In many of these dispensing systems, the discharge of the cleaning liquid is effected by means of a change in the water level within the cistern.

One drawback of such dispensers is that the cover of the toilet cistern has to be temporarily removed or displaced in order for the cleaning material (solid or liquid) or a cartridge containing the cleaning material, to be replenished periodically.

This drawback is largely overcome by Patent Application PCT/IL02/00827 to Eshel, et al., which discloses a chemical dispenser, for use with a flush toilet, which is mounted externally to the toilet cistern using an existing opening in the cistern. It is observed in the above-referenced application that most toilet cisterns are produced with two holes, one on each end of the cistern, to provide for alternative positioning of the water input valve, hence, the chemical dispenser is readily installed on most cisterns without having to drill a new hole therein.

One deficiency in the art taught by the PCT Application to Eshel, et al., is that the chemical dispenser takes up considerable space proximate to the housing of the toilet cistern. In many bathrooms, the allotment of space for such a dispenser is impractical, or even impossible. Moreover, the chemical dispenser provides a large surface area for the collection of dust and dirt, a distinct disadvantage both for home and public bathrooms. The disposition of the chemical dispenser external to the cistern, while simplifying the refilling procedure, also makes the dispenser prone to breakage due to accidental knocks as well as vandalism. The chemical dispenser taught by Patent Application PCT/IL02/00827 is particularly susceptible to vandalism because the bulky dispenser is disposed in plain view.

Hence, there is therefore a recognized need for, and it would be highly advantageous to have, a chemical dispensing device that enables a simple refilling procedure, i.e., without having to displace the cover of the toilet cistern, and yet is largely free of the substantial deficiencies of the known external dispensers. It would be of further advantage if such a device would be compact, aesthetically pleasing, and inexpensive to produce.

SUMMARY OF THE INVENTION

The present invention is a dispenser for introducing chemical supplements to a toilet cistern without having to displace the cover of the toilet cistern.

According to the teachings of the present invention there is provided a device for introducing a chemical supplement to a toilet cistern without having to displace a cover of the toilet cistern, including: (a) a dispensing unit having a releasing mechanism, disposed within the cistern, for releasing the chemical supplement into the cistern, and (b) a housing, associated with the releasing mechanism and disposed within the cistern, for receiving a cartridge containing the chemical supplement, and (c) an attachment mechanism for securing the device to a surface of the toilet cistern.

According to another aspect of the present invention there is provided a cartridge device for containing a chemical supplement to a toilet cistern, including: (a) a housing for containing the chemical supplement, and (b) a securing mechanism, at least part of which is disposed on the housing, for securing the housing within the cistern, the housing being designed and configured to at least partially fit through an opening in a surface of the cistern, and such that the housing can be inserted through the opening without having to displace a cover of the cistern.

According to yet another aspect of the present invention there is provided a method of introducing a chemical supplement to a toilet cistern, including the steps of: (a) providing a cartridge device including: (i) a housing for containing the chemical supplement, and (ii) a securing mechanism, at least part of which is disposed on the housing, for securing the housing within the cistern; (b) inserting the cartridge device through an opening in a surface of the toilet cistern, and (c) securing the cartridge device with respect to the toilet cistern, using the securing mechanism.

According to still further features in the described preferred embodiments, the device further includes: (d) a protruding element, disposed within the housing, and designed and configured to penetrate the cartridge when the cartridge is inserted into the housing.

According to still further features in the described preferred embodiments, the releasing mechanism includes a buoyant plug.

According to still further features in the described preferred embodiments, the plug is a bi-directional buoyant plug.

According to still further features in the described preferred embodiments, the attachment mechanism includes a fitting that fits around the surface.

According to still further features in the described preferred embodiments, the cartridge has a structurally-weakened surface, and wherein the protruding element is designed and configured to penetrate the cartridge in a vicinity of the structurally-weakened surface.

According to still further features in the described preferred embodiments, the releasing mechanism includes a buoyant plug, and wherein the protruding element is disposed on the plug.

According to still further features in the described preferred embodiments, the opening is disposed in the cover of the cistern.

According to still further features in the described preferred embodiments, the opening is disposed in a wall of the cistern.

According to still further features in the described preferred embodiments, the cartridge is designed and configured such that at least a portion of the cartridge can pass through an opening in the cover of the toilet cistern, such that the chemical supplement can be introduced to the cistern without having to displace the cover of the cistern.

According to still further features in the described preferred embodiments, the cartridge is equipped with a handle for facilitating an insertion of the cartridge into the housing, and for securing the cartridge within the cistern.

According to still further features in the described preferred embodiments, the cartridge is equipped with a scent chamber for containing a solid scent for providing a scent to an environment external to the cistern.

According to still further features in the described preferred embodiments, the scent chamber has a disposable covering for covering the solid scent, the disposable covering for removing before the solid scent is activated.

According to still further features in the described preferred embodiments, a surface within the housing includes a securing mechanism for securing the cartridge thereto.

According to still further features in the described preferred embodiments, the securing mechanism includes a first threaded surface that is complementary to a second threaded surface disposed on the cartridge.

According to still further features in the described preferred embodiments, the housing is designed and configured with respect to the opening such that upon insertion of the cartridge device into the opening, the chemical supplement is disposed completely, or at least partially, within the toilet cistern.

According to still further features in the described preferred embodiments, the housing includes a structurally-weakened surface designed and configured such that upon insertion of the cartridge into the opening, the structurally-weakened surface is penetrated by a protruding element within the toilet cistern.

According to still further features in the described preferred embodiments, the cartridge device further includes: (c) a scent chamber, associated with the housing, for containing a solid scent, the chamber designed and configured such that upon insertion of the device into the opening, the chamber is disposed outside the toilet cistern.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings:

FIGS. 1*a* and 1*b* are schematic views of the cartridge device of the present invention according to a first preferred embodiment, in which the cartridge is inserted via the cistern lid, wherein:

FIG. 1*a* shows the cartridge completely inserted within the cistern, and

FIG. 1*b* shows the cartridge in a partially-inserted disposition;

DESCRIPTION OF THE PREFERRED EMBODIMENTS

Figure 1A:
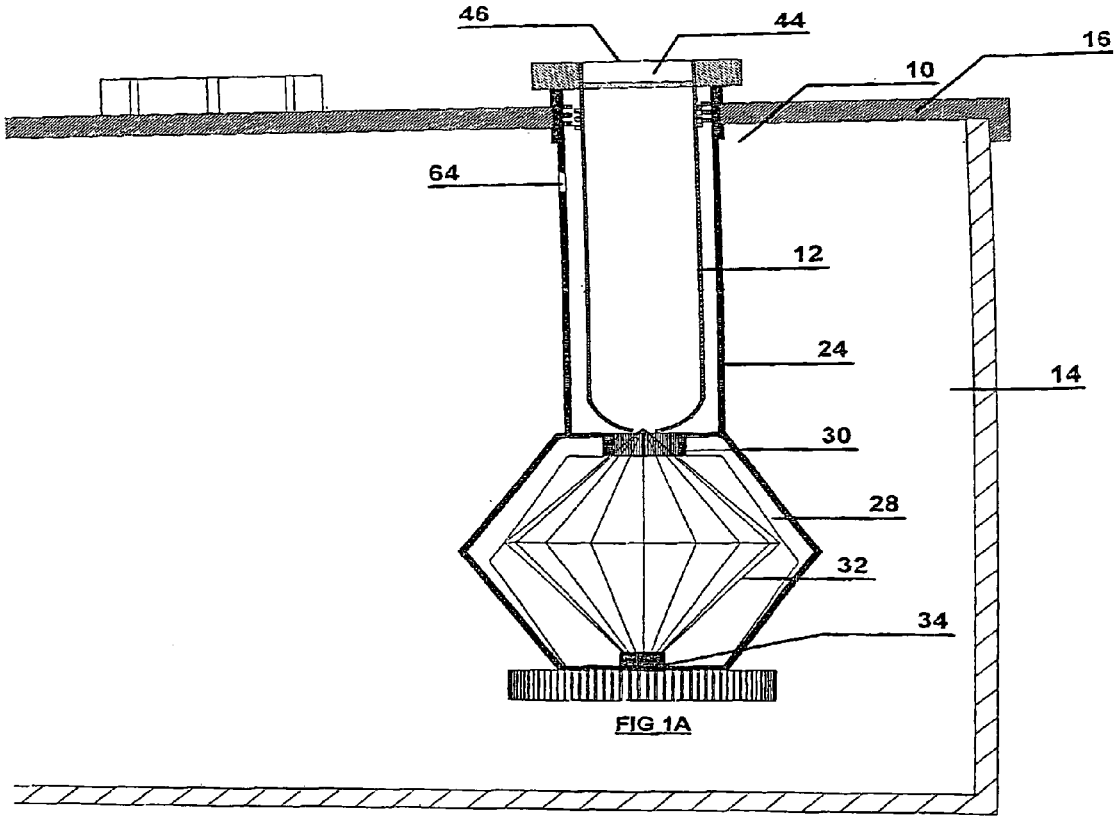

The present invention is a dispenser for introducing chemical supplements to a toilet cistern without having to displace the cover of the toilet cistern.

The principles and operation of the dispenser of the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

The major innovation of the present invention is the replenishment of the supplement from the exterior of the toilet cistern without having to displace the lid of the cistern. This is achieved by utilizing a hole in the toilet cistern that is disposed anywhere above the water level (when the cistern is full). The hole, which can be an existing hole or a dedicated hole built into the toilet cistern for this purpose, can be disposed in the lid or on any side of the cistern.

Referring now to the drawings, FIG. 1*a* is a schematic view of the cartridge device 10 of the present invention according to a first preferred embodiment, in which a tube-shaped cartridge 12 containing a chemical supplement is completely inserted in cistern 14 via an opening in cistern lid 16.

Figure 1B:
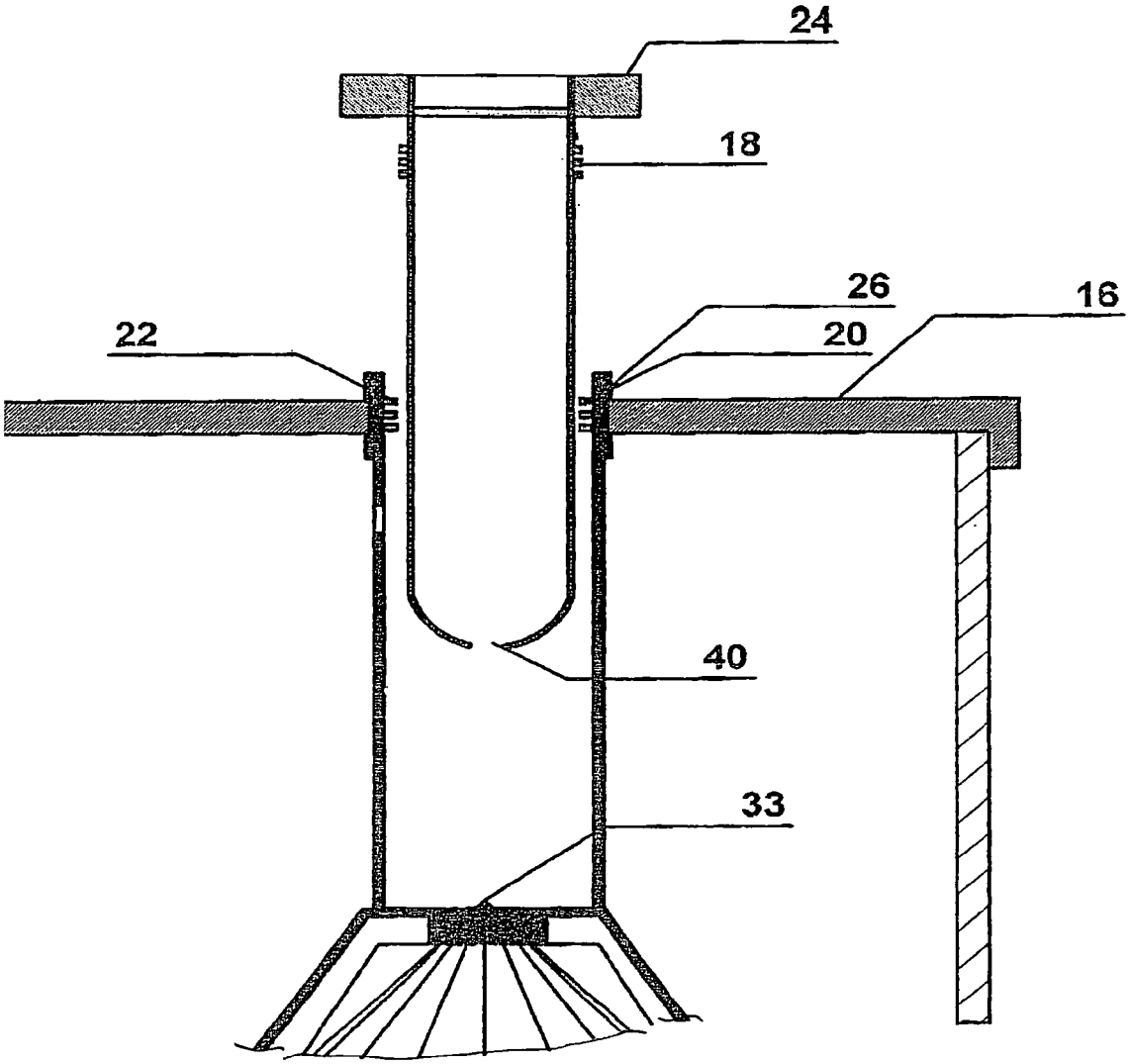

As can be seen with greater clarity in FIG. 1*b*, the side of cartridge 12 has a threaded area 18, and opening 20 in cistern lid 16 (or in cartridge chamber 24) is equipped with threaded area 22 that is complementary to threaded area 18. The top of cartridge 12 is equipped with a handle 24, which facilitates both the insertion of cartridge 12 into cistern 14 and the securing of cartridge 12 to cistern lid 16 by means of complementary threaded areas 18,22.

Inside cistern 14 is disposed a cartridge chamber 24 for housing cartridge 12. Cartridge chamber 24 is firmly affixed to cistern lid 16 by housing adaptor 26, which preferably fits snugly around both the inside and outside surfaces of cistern lid 16.

It is evident that many alternatives for securing the cartridge 12 to cartridge chamber 24 or to cistern lid 16 or to cistern wall 112 (shown in FIG. 3 hereinbelow) will be apparent to those skilled in the art.

Disposed below cartridge chamber 24 is dispensing chamber 28, which serves to dispense the chemical supplement from cartridge chamber 24 into cistern 14, as will be explained in greater detail hereinbelow. Cartridge chamber 24 and dispensing chamber 28 fluidly communicate through upper ring 30. Within dispensing chamber 28 is disposed buoyant plug 32, which is designed to alternatively block fluid communication in two directions:

(1) between dispensing chamber 28 and lower ring (or orifice) 34, such that the chemical supplement is able to flow into dispensing chamber 28 ("down position", or "open position"), but water from cistern 14 is blocked from flowing into dispensing chamber 28;

(2) between cartridge chamber 24 (and/or cartridge 12) and dispensing chamber 28, such that the chemical supplement is not introduced into cistern 14 via dispensing chamber 28 ("up position", or "closed position").

An air hole 64 is advantageously disposed in a wall of cartridge chamber 24 (in the event that the wall fluidly seals between the inside and outside of cartridge chamber 24), or possibly in a wall of cartridge 12 (in the event that the cartridge wall fluidly seals between the inside and outside of cartridge 12).

Figure 2A:
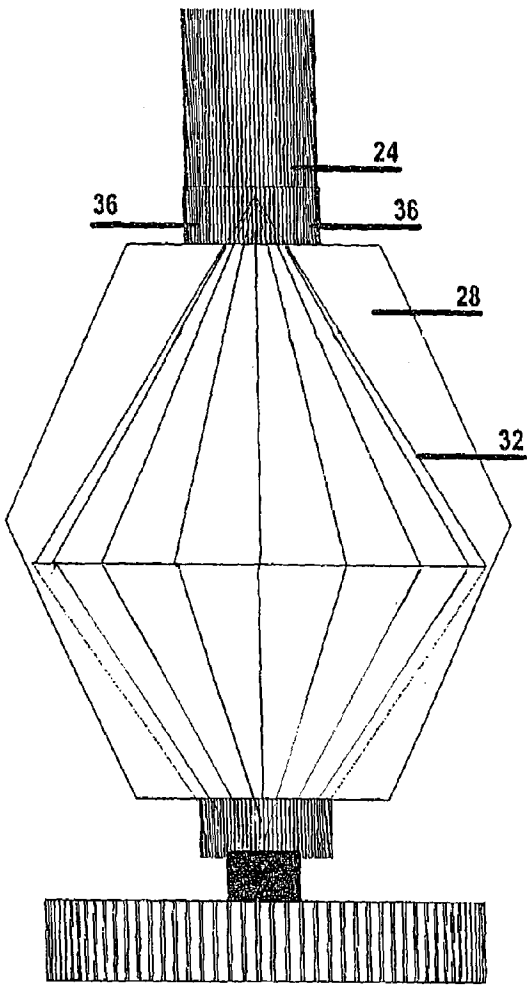
FIGS. 2*a*–2*b* are schematic illustrations of the buoyant plug in an open position and in a closed position, respectively.
Figure 2B:
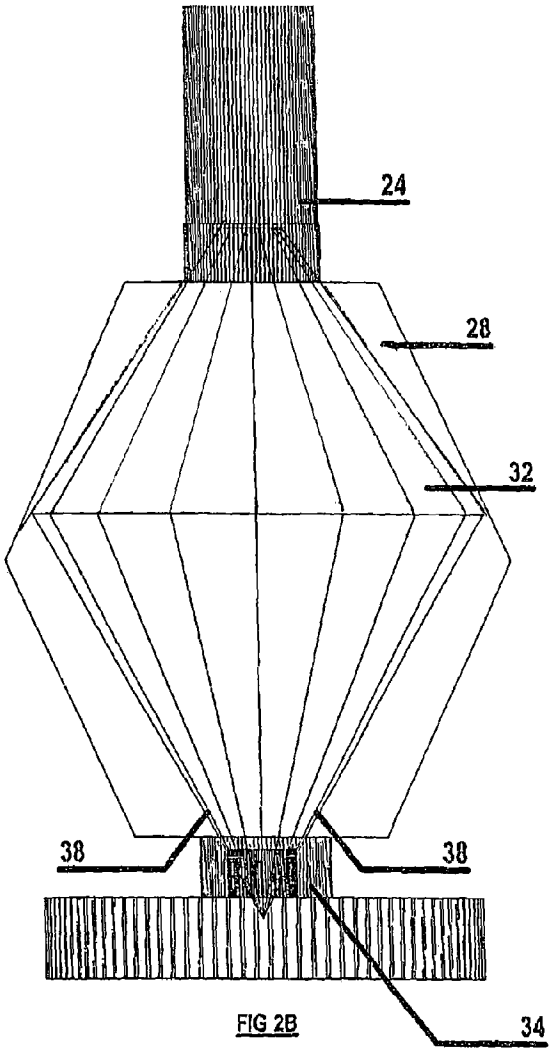

FIGS. 2*a*–2*b* are schematic illustrations showing the buoyant plug in an open position (FIG. 2*a*), and in a closed position (FIG. 2*b*). Upon flushing the toilet, there is no water to support the device, hence buoyant plug 32 falls to a down or open position, such that the chemical supplement flows from cartridge chamber 24 into dispensing chamber 28 (see arrows 36 in FIG. 2*a*).

During the filling of the water cistern, buoyant plug 32 is buoyed by the water, and is reelevated. Once buoyant plug 32 has reattained its starting position (FIG. 2*b*), such that the communication between cartridge chamber 24 and dispensing chamber 28 has been sealed, the chemical supplement, which is substantially incompressible, is released from dispensing chamber 28 via lower ring 34, into the water tank (see arrows 38 in FIG. 2*b*).

Thus, as described hereinabove, buoyant plug 32, dispensing chamber 28, upper ring 30, and lower ring 34 cooperate to form a releasing mechanism for releasing the chemical supplement into the water tank. invention according to another preferred embodiment, in which a cartridge 102 is inserted via an opening 110 in a wall 112 of cistern 14. Since most toilet cisterns are produced with two holes, one on each end of the cistern, to provide for alternative positioning of the water input valve, cartridge device 100 is readily installed on most cisterns without having to drill a new hole therein.

Figure 3:
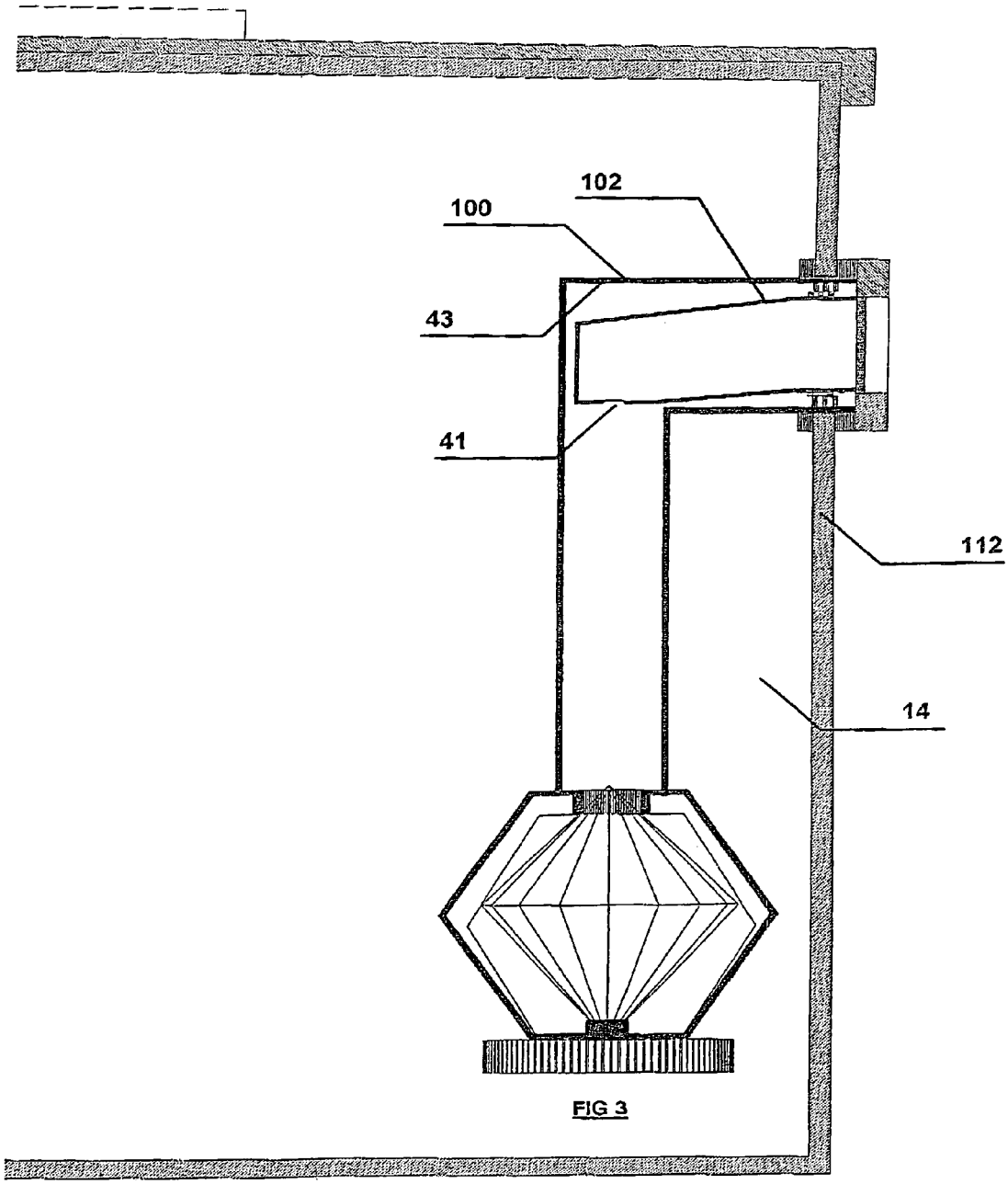
FIG. 3 is a schematic illustration of the cartridge device of the present invention according to another preferred embodiment, in which the cartridge is inserted via an opening in a wall of the cistern.

Referring back to FIG. 1*b*, cartridge 12 is advantageously equipped with a structurally-weakened surface 40, typically disposed in the bottom surface of cartridge 12. Upon insertion of cartridge 12 into cartridge chamber 24, structurally-weakened surface 40 is penetrated by a sharp surface 33 within cartridge chamber 24. In FIG. 1*b*, the sharp surface is disposed on buoyant plug 32. In FIG. 3, structurally-weakened surface 41 and sharp surface 43 within cartridge chamber 24 are designed and configured such that structurally-weakened surface 41 is penetrated by sharp surface 43, preferably while cartridge 12 is being screwed into place.

In another preferred embodiment of the present invention, shown in FIG. 1*a*, handle 24 of cartridge 12 is at least partially hollow, so as to serve as a scent container 44 for containing a perfume, deodorizer, or the like. Preferably, the solid scent material in scent container 44 is covered by a foil or other disposable covering 46. Thus, after cartridge 12 is installed in cistern 14, disposable covering 46 is removed from scent container 44, exposing the active material therein to the environment, and initiating the scenting of the air.

It must be emphasized that in addition to enabling the user to provide a chemical supplement to the water cistern without having to remove the cistern lid, the present invention enables the user to utilize a liquid chemical supplement without having to store the supplement outside the water cistern, and without having to deal directly with the liquid (and the spilling thereof). The liquid is introduced within a cartridge, and is not exposed to the environment outside of the cistern.

It must be further emphasized that the present invention provides a mechanism for firmly securing the container for holding the chemical supplement to the lid or wall of the cistern. Furthermore, the present invention serves to contain the chemical supplement within the cistern, while also containing a solid scent material for scenting the environment around the cistern. The solid scent material is firmly fixed to the lid or external wall of the cistern, such that no additional device is required for holding the material, and moreover, the scent material does not take up additional space on top of the cistern lid (or on another surface in the bathroom), nor is the scent material subject to being moved around, knocked over, etc., as with conventional containers for holding such materials.

As used herein in the specification and in the claims section that follows, the term "internal surface of the toilet cistern" refers to an internal surface of the cistern body or to an internal surface of the cistern lid.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A device for introducing a chemical supplement to a toilet cistern without having to displace a cover of the toilet cistern, the device comprising:

(a) a releasing mechanism for releasing the chemical supplement into the toilet cistern, said mechanism for disposing within the cistern;

(b) a cartridge for containing the chemical supplement, said cartridge for at least partially disposing within the toilet cistern;

(c) a housing for receiving said cartridge, said housing associated with said releasing mechanism, said housing for disposing within the toilet cistern;

(d) an attachment mechanism for securing the device to a surface of the toilet cistern, and (e) a protruding element, disposed within said housing, and designed and configured to penetrate said cartridge when said cartridge is disposed in said housing.

2. The device of claim 1, wherein said releasing mechanism is designed and configured to have an open position and a closed position, wherein in said closed position, said releasing mechanism blocks a flow of the chemical supplement into the cistern, and wherein in said open position, said releasing mechanism allows a flow of the chemical supplement into the cistern.

3. The device of claim 1, wherein said releasing mechanism includes a buoyant plug.

4. The device of claim 3, wherein said plug is a bi-directional buoyant plug.

5. The device of claim 1, wherein said attachment mechanism includes a fitting that fits around said surface.

6. The device of claim 1, wherein said cartridge has a structurally-weakened surface, and wherein said protruding element is designed and configured to penetrate said cartridge in a vicinity of said structurally-weakened surface.

7. The device of claim 1, wherein said releasing mechanism includes a buoyant plug, and wherein said protruding element is disposed on said plug.

8. The device of claim 1, wherein said surface of the toilet cistern is disposed on the cover of the cistern.

9. The device of claim 1, wherein said surface of the toilet cistern is disposed on a wall of the cistern.

10. The device of claim 1, wherein said cartridge includes a container for containing the chemical supplement, and a securing mechanism, at least part of which is disposed on said housing, for securing said container within the cistern, said container being designed and configured to at least partially fit through an opening in a surface of the cistern, and such that said container can be inserted through said opening without having to displace a cover of the toilet cistern.

11. The cartridge device of claim 10, wherein said container is designed and configured with respect to said opening such that upon insertion of the device into said opening, the chemical supplement is disposed within the toilet cistern.

12. The cartridge device of claim 10, wherein said housing includes a structurally-weakened surface designed and configured such that upon insertion of the device into said opening, said structurally-weakened surface is penetrated by a protruding element within the toilet cistern.

13. The cartridge device of claim 10, further comprising:

(f) a scent chamber, associated with said housing, for containing a solid scent, said chamber designed and configured such that upon insertion of the device into said opening, said chamber is disposed outside the toilet cistern.

14. A device for introducing chemical supplement to a toilet cistern without having to displace a cover of the toilet cistern, the device comprising:

(a) a releasing mechanism for releasing the chemical supplement into the toilet cistern, said mechanism for disposing within the cistern;

(b) a cartridge for containing the chemical supplement, said cartridge for at least partially disposing within the toilet cistern;

(c) a housing for receiving said cartridge said housing associated with said releasing mechanism, said housing for disposing within the toilet cistern, and (d) an attachment mechanism for securing the device to a surface of the toilet cistern, wherein said cartridge is designed and configured such that at least a portion of said cartridge can pass through an opening in the cover of the toilet cistern, such that the chemical supplement can be introduced to the cistern without having to displace the cover of the cistern.

15. The device of claim 14, wherein said cartridge is equipped with a handle for facilitating an insertion of said cartridge into said housing, and for securing said cartridge within the cistern.

16. The device of claim 14, wherein said releasing mechanism is designed and configured to have an open position and a closed position, wherein in said closed position, said releasing mechanism blocks a flow of the chemical supplement into the cistern, and wherein in said open position, said releasing mechanism allows a flow of the chemical supplement into the cistern.

17. A device for introducing a chemical supplement to a toilet cistern without having to displace a cover of the toilet cistern, the device comprising;

(a) a releasing mechanism for releasing the chemical supplement into the toilet cistern, said mechanism for disposing within the cistern;

(b) a cartridge for containing the chemical supplement, said cartridge for at least partially disposing within the toilet cistern;

(c) a housing for receiving said cartridge, said housing associated with said releasing mechanism, said housing for disposing within the toilet cistern, and (d) an attachment mechanism for securing the device to a surface of the toilet cistern, wherein said cartridge is equipped with a scent chamber for containing a solid scent for providing a scent to an environment external to the cistern.

18. The device of claim 17, wherein said scent chamber has a disposable covering for covering said solid scent, said disposable covering for removing before said solid scent is activated.

19. The device of claim 17, wherein a surface within said housing includes a securing mechanism for securing said cartridge thereto.

20. The device of claim 19, wherein said securing mechanism includes a first threaded surface that is complementary to a second threaded surface disposed on said cartridge.

* * * * *